United States Patent [19]

Butterwick

[11] 4,376,246

[45] Mar. 8, 1983

[54] SHIELDED FOCUSING ELECTRODE ASSEMBLY FOR A PHOTOMULTIPLIER TUBE

[75] Inventor: Gilbert N. Butterwick, Leola, Pa.

[73] Assignee: RCA Corporation, New York, N.Y.

[21] Appl. No.: 227,342

[22] Filed: Jan. 22, 1981

[51] Int. Cl.[3] ..... H01J 39/00

[52] U.S. Cl. ..... 250/207; 313/94

[58] Field of Search ..... 250/207, 213 VT; 313/94

[56] References Cited

U.S. PATENT DOCUMENTS

| | | | |
|---|---|---|---|
| 2,574,356 | 11/1951 | Sommer | 316/20 |
| 2,908,840 | 10/1959 | Anderson | 313/94 |
| 3,838,304 | 9/1974 | McDonie | 313/94 |

*Primary Examiner*—David C. Nelms
*Assistant Examiner*—Darwin R. Hostetter
*Attorney, Agent, or Firm*—Eugene M. Whitacre; Dennis H. Irlbeck; Vincent J. Coughlin, Jr.

[57] ABSTRACT

An improved photomultiplier tube comprises an evacuated envelope having a faceplate extending across one end thereof. A photoemissive cathode is disposed on the interior surface of the faceplate. A support electrode having a centrally located aperture therethrough is spaced from the faceplate. An electron multiplier assembly is attached to the support electrode. A focusing assembly is disposed about the centrally located aperture in the support electrode on a side of the support electrode opposite the electron multiplier assembly. The focusing electrode assembly comprises an insulating member having a generally tubular body with an interior surface and an exterior surface and having a proximal end and a distal end. A top-cap, having a substantially U-shaped cross-section including a flat central base and two mutually parallel projections at the ends of the base, is attached to the distal end of the insulating member. The parallel projections are directed toward the support electrode and extend along at least a portion of the interior and exterior surfaces of the insulating member. At least one antimony evaporator for forming the photocathode is disposed adjacent to the focusing assembly. One of the projections at the end of the top-cap shields the exterior surface of the insulating member from antimony deposition and thus prevents electrical shorting of the focusing assembly to the support electrode. The other projection shields the interior of the insulating member from impingement by photoelectrons from the photocathode and thereby prevents electrical charging of the insulating member. A focus potential is applied to the top-cap of the focusing electrode assembly to focus the photoelectrons into the electron multiplier assembly.

8 Claims, 2 Drawing Figures

SHIELDED FOCUSING ELECTRODE ASSEMBLY FOR A PHOTOMULTIPLIER TUBE

BACKGROUND OF THE INVENTION

The invention relates to electron discharge tubes and particularly to a shielded focusing electrode assembly for a photomultiplier tube.

Photomultiplier tubes for use in severe environments, such as oil well logging, are described in my copending U.S. patent application Ser. No. 216,906, filed Dec. 16, 1980 and entitled, "PHOTOMULTIPLIER TUBE HAVING A STRESS ISOLATION CAGE ASSEMBLY". The copending patent application is assigned to the same assignee as the present invention and is incorporated herein for disclosure purposes. The photomultiplier tube described in the above cited copending patent application is known as the RCA C33016G photomultiplier tube. The tube comprises a glass envelope structure having a photocathode formed on the interior surface of the envelope faceplate. An electron multiplier including a plurality of secondary emissive dynodes and an anode is spaced from the photocathode to receive photoelectrons therefrom. An apertured shield cup is disposed intermediate the photocathode and the electron multiplier to focus the photoelectrons from the photocathode onto the electron multiplier. As described in my copending application, such tubes experience operating temperatures in the range of between 100°-250° C. In order to make a more rugged tube, capable of operating with good electrical stability at temperatures in excess of 150° C., a ceramic-metal envelope having a sapphire faceplate has been designed. In order to construct such a tube at reasonable cost, a plano-plano sapphire window is used rather than the plano-concave window used in the glass envelope tube of the copending patent application. A ceramic-metal tube with such a plano-plano input window and an apertured shield cup identical to that described in the copending patent application demonstrated poor electron collection efficiency and pulse height resolution.

Electron collection efficiency is defined as the ratio of the number of photoelectrons incident on the first dynode of the electron multiplier to the number of photoelectrons emitted from the photocathode. In many scintillation counting applications, such as oil well logging, a photomultiplier tube is coupled to a thallium-activated sodium iodide crystal in which scintillations are produced by gamma rays resulting from nuclear disintegrations. Because the output of a photomultiplier is linear with light input and because the light energy of scintillations is directly proportional to the gamma-ray energy over a certain range, an electrical pulse is obtained which is a direct measure of the gamma-ray energy. Consequently, an important requirement of photomultipliers used in nuclear spectrometry is the ability to discriminate between pulses of various heights. The parameter indicating the ability of a tube to perform this discrimination is called pulse-height resolution. Pulse-height resolution is defined as the width of the photopeak at half the maximum count rate divided by the pulse height at maximum count rate. Consequently, the lower the pulse-height resolution, the greater the ability of the photomultiplier to discriminate between pulses of nearly equal height.

A focusing electrode in addition to the above-described apertured shield cup is required between the photocathode and the electron multiplier in order to focus substantially all the photoelectrons from the photocathode onto the first dynode of the electron multipliers thereby improving the electron collection efficiency and the pulse-height resolution of the tube.

SUMMARY OF THE INVENTION

An improved photomultiplier tube of the type having an evacuated envelope, a faceplate extending across one end of the envelope, an electron multiplier and a photoemissive cathode disposed on the interior surface of the faceplate includes an electron multiplier support electrode spaced from the faceplate and having a centrally located aperture extending therethrough. A focusing assembly is disposed about the centrally located aperture of the support electrode. At least one antimony evaporator is disposed adjacent to the focusing assembly for evaporating antimony on the faceplate during the formation of the photoemissive cathode. The focusing assembly comprises an insulating member having a generally tubular body with an exterior surface and an interior surface and having a proximal end and a distal end. Means for focusing photoelectrons from the photoemissive cathode into the electron multiplier and for shielding both the interior surface of the insulating member from photoelectrons impinging thereon and the exterior surface of the member from antimony evaporated during the formation of the photoemissive cathode is provided.

DETAILED DESCRIPTION OF THE PREFERRED EMBODIMENT

Figure 1:
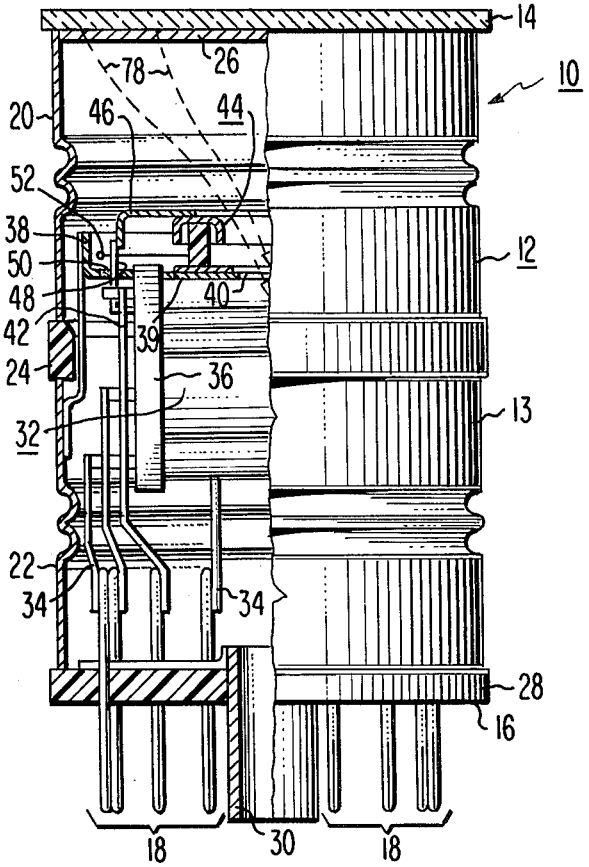
FIG. 1 is an enlarged view partially in axial section of a photomultiplier tube in which the present invention is incorporated.

Referring to the drawings, there is shown in FIG. 1 a photomultiplier tube 10 comprising an evacuated envelope 12 having a generally cylindrical sidewall 13, a transparent faceplate 14 and a stem section 16 through which a plurality of support leads 18 are sealed. The envelope 12 includes a cathode subassembly 20 and a stem subassembly 22. The cathode subassembly 20 is separated from the stem subassembly 22 by a ceramic member 24 brazed between the cathode and stem subassemblies. A photoemissive cathode (hereinafter called the photocathode) 26 is formed on the interior surface of the faceplate 14. The cathode 26 provides photoelectrons in response to radiation incident thereon. The faceplate 14 is shown to be a plano-plano window, for example of sapphire or other suitable materials although sapphire is preferred. The sapphire faceplate 14 provides a reasonable cost, nonreactive substrate on which to form the photocathode 26. The stem 16 is a ceramic-metal structure comprising a ceramic base 28 and a metal tubulation 30. The metal tubulation 30 is preferably made of a copper alloy which may be cold-welded subsequent to photocathode formation to form a vacuum seal. The tubulation 30 is brazed to the ceramic plate 28 by a method well known in the art. The stem leads 18 extend through the ceramic plate 28 and are vacuum sealed thereto, e.g., by brazing.

An electron multiplier cage assembly, indicated generally as 32, is supported within the envelope 12 by a plurality of cage leads 34 (only some of which are shown). The cage leads 34 are attached at one end to the internally projecting stem leads 18. The cage assembly 32 comprises a plurality of dynodes supported between a pair of dynode support spacers 36, only one of which is shown. The dynodes comprise secondary emissive electrodes for propagating and concatenating electron emission from the photocathode 26 to an anode (not shown) enclosed within the last dynode. For high temperature operation, dynodes formed from a beryllium copper alloy and having a beryllium-oxide secondary emissive surface are preferred; although nickel dynodes having an alkali antinomide secondary emissive surface may be used at lower operating temperatures.

The dynode support spacers 36 are attached to a support electrode 38 which is spaced from the faceplate 14. The support electrode 38 is preferably a cup-shaped conductive member having a substantially flat base 39 and a centrally disposed aperture 40 extending therethrough. Electrical connection between the envelope wall 12 and the support electrode 38 is provided by a connecting strap 42. A focusing electrode assembly 44 is disposed substantially concentrically about the centrally located aperture 40 of the support electrode 38 on a side of the support electrode 38 opposite the electron multiplier assembly 32. A connecting lead 46 is attached at one end to the focusing assembly 44 and at the other end to a stand-off electrode 48 extending through a ceramic feedthrough 50 which is located in the flat base 39 of the support electrode 38.

An antimony evaporator 52 is disposed within the support electrode 38 in order to form the photocathode 26 on the faceplate 14. Preferably, two antimony evaporators 52, oppositely disposed within the support electrode, are used to uniformily evaporate an antimony film on the faceplate 14. As is well known in the art, the antimony film reacts with alkali vapors from alkali generators (not shown) to form the photocathode 26.

Figure 2:
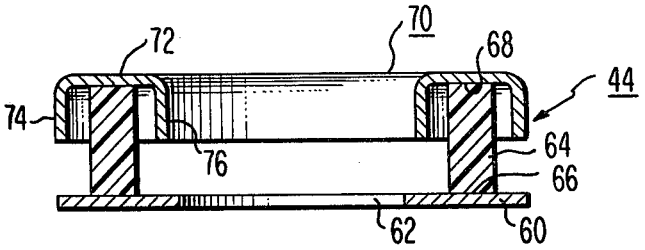
FIG. 2 is an enlarged sectional view of the focusing assembly partially shown in FIG. 1.

The novel focusing electrode assembly 44 is shown in enlarged detail in FIG. 2. The focusing assembly 44 comprises a substantially flat conductive annular member 60 having a centrally disposed aperture 62 therethrough. Attached to one surface of the member 60 is an insulating member 64, preferably a tubular ceramic cylinder having an exterior surface and an interior surface, and having a proximal end 66 and a distal end 68. The proximal end 66 and the distal end 68 provide sealing surfaces for sealing the ceramic member 64 to the annular member 60 and to a conductive top-cap 70, respectively. The ends 66 and 68 are metallized and plated by a method well known in the art. The top-cap 70 provides a means for shielding at least a portion of the insulating member 64 from the antimony evaporated from the antimony source 52 and used to form the photocathode 26. The top-cap 70 has a substantially U-shaped cross-section comprising a substantially flat central base portion 72 and two mutually parallel projections 74 and 76 at the ends thereof. The top-cap 70 is disposed upon and attached, e.g., by brazing, to the distal end 68 of the insulating member 64 such that the parallel projections 74 and 76 of the top-cap 70 are directed towards the annular member 60. The projections 74 and 76 are spaced from and extend along about one-half the exterior and interior surfaces, respectively, of the insulating member 64. Shielding of a portion of the exterior surface of the insulating member 64 from antimony source 52 is provided by projection 74. As shown in FIG. 1, the assembly 44 is then attached, e.g., by welding to the base 39 of the support electrode 38.

The operation of the present novel focusing assembly 44 may be understood by reference to FIG. 1. The photocathode 26 and the support electrode 38 may be operated at a common negative potential. The potentials applied to the dynodes of the electron multiplier assembly 32 are progressively more positive than the photocathode potential and the anode (not shown) is generally at ground potential. The top-cap 70 of the focusing assembly 44 is operated at a potential positive with respect to the photocathode and support electrode. In the simplest operating configuration, the top-cap 70 of the focusing assembly 44 may be connected directly to the first dynode potential by means of the lead 46 and the stand-off electrode 48, one end of which is connected directly to the first dynode. An external voltage divider (not shown) is provided to establish the desired operating voltages for the tube elements. Typical photoelectron trajectories from the photocathode 26 to the electron multiplier 32 are shown by the dashed lines 78. The operating voltages are directed into the tube by means of the stem leads 18 extending through the base 28. The above-described structure, with the top-cap 70 of the focusing assembly 44 operating at first dynode potential, provides adequate pulse-height resolution and performance essentially equal to that of the C33016G described in the aforementioned pending patent application Ser. No. 216,906, filed Dec. 16, 1980. The projection 76 of the top-cap 70 shields a portion of the interior surface of the insulating member 64 from photoelectron impingement and thus reduces the electrostatic charging of member 64. It has been determined that the pulse-height resolution may be optimized by operating the top-cap 70 of the focusing assembly 44 at about one-third the potential of the first dynode. This may be achieved by adjusting the external voltage divider (not shown) to provide the desired voltage on the focusing electrode by means of one of the lead-in pins 18. In this structure, the support electrode 38 continues to be operated at cathode potential. As shown in FIG. 1, the support electrode 38 is connected to the stem subassembly 22 via the internal strap 42. Cathode potential is applied to the support electrode 38 by placing an external conductive jumper (not shown) between the cathode subassembly 20 and the stem subassembly 22. The jumper extends over the ceramic insulator 24 and provides cathode potential to the metal surfaces of the envelope 12. One of the stem leads 18 has an internally projecting end connected via an internal connecting strip (not shown) to the stem subassembly 22 portion of the envelope 12 to provide the desired cathode potential.

Electron optics tests have shown that a further increase in pulse-height resolution may be obtained by operating the support electrode 38 at a potential approximately ten percent above, i.e., more positive than cathode potential. In this configuration, the top-cap 70 of the focusing assembly 44 is operated at about one-third the first dynode potential. As explained above, these potentials may be provided by an external voltage divider and require no significant structural changes in the photomultiplier tube 10. In this configuration, the aforementioned external jumper is omitted and separate pins 18 are utilized to provide cathode potential to the cathode subassembly 20 and a potential about ten percent above cathode potential to the support electrode 38 via the strap 42 extending between the stem subassembly 22 and the support electrode.

What is claimed is:

1. In a photomultiplier tube of the type including an evacuated envelope, a faceplate having an interior and an exterior surface, said faceplate extending across one end of said envelope, a stem section sealing the other end of said envelope, a photoemissive cathode disposed on the interior surface of said faceplate, said cathode providing photoelectrons in response to radiation incident thereon, an electron multiplier support electrode spaced from said faceplate, said support electrode having a centrally located aperture extending therethrough, a focusing electrode assembly disposed about said aperture of said support electrode, at least one antimony evaporator disposed adjacent to said focusing assembly for evaporating antimony onto the faceplate during the formation of said photoemissive cathode, an electron multiplier attached to said support electrode, and an anode within said electron multiplier, the improvement wherein said focusing electrode assembly comprises:

an insulating member having a generally tubular body with an exterior surface and an interior surface and having a proximal end and a distal end, said proximal end being adjacent to said support electrode, and means for focusing said photoelectrons from said photocathode into said electron multiplier and for shielding both said interior surface of said insulating member from photoelectrons impinging thereon and said exterior surface of said member from antimony evaporated during the formation of said photoemissive cathode.

2. The tube as in claim 1 wherein said focusing assembly further includes a conductive annular member attached to said proximal end of said insulating member and disposed between said insulating member and said support electrode.

3. The tube as in claim 1 wherein electrical connecting means are attached to said means for focusing and shielding.

4. The tube as in claim 3 wherein said electrical connecting means includes a connecting lead and a stand-off electrode, one end of said connecting lead being attached to said means for focusing and shielding, the other end of said connecting lead being attached to said stand-off electrode.

5. The tube as in claim 1 wherein said insulating member comprises a ceramic cylinder.

6. The tube as in claim 5 wherein said means for focusing and shielding comprises a conductive annular top-cap, said top-cap having a substantially U-shaped cross-section with a substantially flat central base portion and two mutually parallel projections at the ends thereof, said base portion being attached to said distal end of said ceramic cylinder so that said parallel projections of said top-cap are directed toward said support electrode.

7. The tube as in claim 6 wherein said two mutually parallel projections of said top-cap are spaced from said interior and exterior surfaces of said ceramic cylinder, said projections extending along said surfaces for about one-half the length of said cylinder.

8. A method of operating a photomultiplier tube of the type including an evacuated envelope having a faceplate, a photoemissive cathode disposed on said faceplate, an electron multiplier support electrode spaced from said faceplate, said support electrode having a centrally located aperture extending therethrough, an electron multiplier assembly attached to said support electrode, said electron multiplier assembly including a plurality of dynodes and an anode, and a focusing electrode assembly disposed about said centrally located aperture on a side of said support electrode opposite said electron multiplier assembly, said focusing electrode assembly comprising a ceramic cylinder having one end adjacent to said support electrode and a conductive annular top-cap attached to the other end of said ceramic cylinder, the method comprising:

i. applying a negative potential to said cathode, ii. applying a potential to said support electrode, said potential ranging from said cathode potential to a potential about ten percent more positive than said cathode potential, iii. applying a potential to each of said dynodes in said electron multiplier assembly that is progressively more positive than the potential applied to said cathode, iv. applying ground potential to said anode, and v. applying a potential to said top-cap of said focusing electrode assembly, said potential ranging from about one-third the potential applied to the first of said dynodes of said electron multiplier to a potential equal to the potential applied to the first of said dynodes.

* * * * *